United States Patent [19]

Samuelson

[11] 4,074,898

[45] Feb. 21, 1978

[54] METAL BEAM GUARD RAIL ASSEMBLING CLAMP

[76] Inventor: Charles G. Samuelson, 1136 Riverside Drive, Rio Dell, Calif. 95562

[21] Appl. No.: 776,595

[22] Filed: Mar. 11, 1977

[51] Int. Cl.[2] ..... B25B 1/14

[52] U.S. Cl. ..... 269/228

[58] Field of Search ..... 269/228; 81/111, 117

[56] References Cited

U.S. PATENT DOCUMENTS

| | | | |
|---|---|---|---|
| 1,638,703 | 8/1927 | Pendleton | 81/111 |
| 2,923,508 | 2/1960 | Daugherty | 269/228 |

FOREIGN PATENT DOCUMENTS

| | | | |
|---|---|---|---|
| 314,975 | 10/1953 | Switzerland | 269/228 |

*Primary Examiner*—Robert C. Watson

*Attorney, Agent, or Firm*—Boone, Schatzel, Hamrick & Knudsen

[57] ABSTRACT

A tool for clamping the ends of two guard rail sections including a fixed jaw rigidly attached to a first handle, a second handle pivotally attached to the first handle and a pivoting jaw pivotally attached to the first handle and pivotally connected to the second handle by means of an overcenter linkage.

5 Claims, 3 Drawing Figures

METAL BEAM GUARD RAIL ASSEMBLING CLAMP

BACKGROUND OF THE INVENTION

1. Field of the Invention

The present invention relates generally to clamping devices and more particularly to a special purpose clamp having a pivotable jaw with an overcenter linkage for use in installing guard rail sections.

2. Description of the Prior Art

Typically, highway divider guard rails are comprised of 12 foot 6-inch corrugated sections. The guard rails are spliced together by overlapping the ends of sections and securing them with eight securing bolts. Due to the corrugated curvature of the guard rail sections, the sections do not snugly mate when overlapped. This causes a problem due to the fact that the securing holes do not simultaneously align.

Heretofore, assembly has been accomplished by the use of a pointed pry bar inserted and twisted in a first set of holes forcing alignment of a second set of holes. This permits the insertion of a bolt in the second set of holes. This procedure is repeated until all of the securing bolts have been inserted.

One prior art device for holding a nut under a hole in corrugated building material is disclosed in the U.S. Pat. No. 2,935,314 of Ford. The Ford disclosure includes a base for fitting under the corrugated material and for holding the nut, a curved leg attached to the base, an arm pivotally attached to the leg at a point above the building material, a lever and link assembly pivotably attached to both the leg and the arm and a spring attached to the leg and the link for urging the link and arm toward the material maintaining the nut in position under the hole. Force on the lever is transmitted to the link opposing the spring and lifting the arm permitting insertion or removal of the material. Although useful in holding the nut in alignment, the clamping force afforded by the spring is insufficient to snugly mate sections of guard rail.

SUMMARY OF THE INVENTION

It is therefore an object of the present invention to provide a clamp which will provide sufficient compressive force to align the securing bolt holes in overlapped guard rail sections.

Another object of the present invention is to provide a clamp which does not require the continuous application of force to maintain the securing bolt holes in overlapped guard rail sections in alignment.

Briefly, the preferred embodiment of the present invention includes a fixed jaw rigidly attached to a first handle, a second handle pivotally attached to the first handle and a pivoting jaw pivotally attached to the first handle and pivotally connected to the second handle by means of an overcenter linkage.

An important advantage of the present invention is that one person using the invention can rapidly install guard rail sections.

IN THE DRAWING

DETAILED DESCRIPTION OF THE PREFERRED EMBODIMENT

Figure 1:
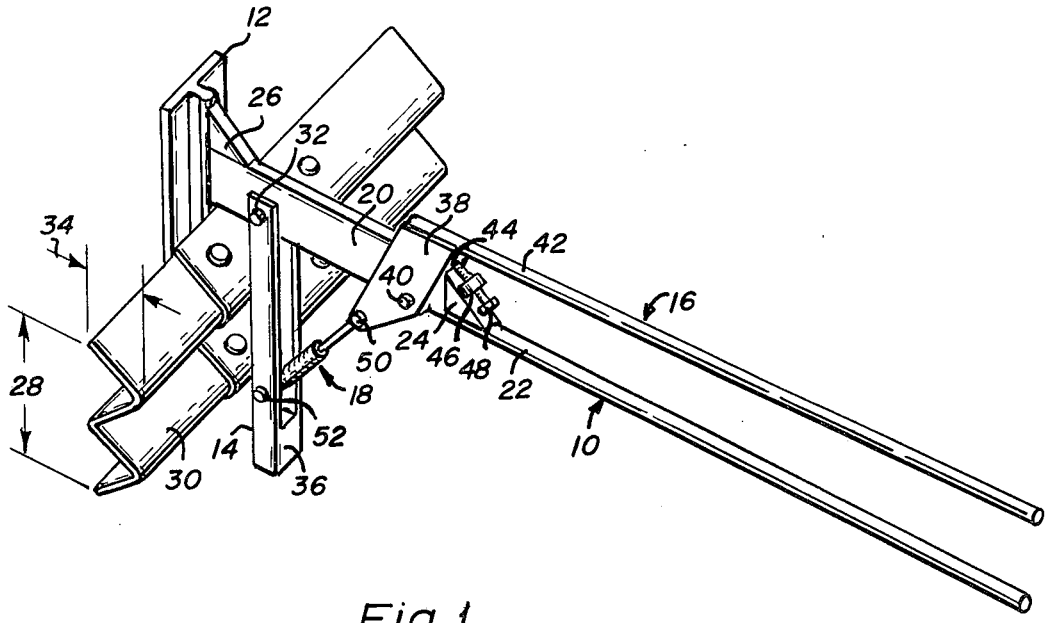
FIG. 1 is a perspective view showing a metal beam guard rail assemblying clamp in accordance with the present invention.

Referring to FIG. 1, the preferred embodiment of a metal beam guard rail assembling clamp is shown generally to include a first handle 10, a fixed jaw 12, a pivoting jaw 14, a second handle 16, and an overcenter linkage 18. In the preferred embodiment, handle 10 includes a generally rectangular elongated portion 20 having first and second ends and a generally rod-shaped portion 22. The first end adjacent the bottom of the elongated portion intersects one end of the rod-shaped portion which is disposed parallel the major axis of the rectangle of the elongated portion. Also disposed at the intersection of the elongated portion and rod-shaped portion is a strengthening web, or triangular brace, 24.

The second end of elongated portion 20 is disposed substantially perpendicular to and near the top of fixed jaw 12. The fixed jaw is of elongated shape which in the preferred embodiment has a generally I-shaped cross section providing a balance between strength and weight. Additional strength is provided by a second strengthening web, or triangular brace, 26 which is disposed at the juncture of the elongated portion and the fixed jaw. The fixed jaw extends below the elongated portion a distance in excess of the width 28 of two overlapping guard rail sections 30.

Pivoting jaw 14, which has an elongated shape, is pivotally attached to the first handle at point 32. The pivoting jaw is disposed a distance from the fixed jaw equal to the thickness of two guard rail sections when the sections are overlapped and compressed, as shown at 34. Preferably, the pivoting jaw is of channel shape having the bottom of a first end open forming ears which overlap and are pivotally attached to the first handle by a suitable mounting bolt at point 32. The channel extends below the first handle a distance substantially equal to one guard rail width 28. The top of the second end of the channel is closed forming a generally rectangular shaped strengthening portion 36.

Second handle 16 includes a lever member 38 pivotally attached to the first handle at a point 40 and an elongated member member 42 attached to the lever member. Preferably, lever member 38 has two similar generally flat portions disposed on either side of the first handle and pivotally attached to the first handle by a suitable mounting bolt at point 40. The flat portions intersect along their top sides member 42, which is long and rod-shaped.

Also included is a stop which includes a striking plate 44, a bolt mount 46 and an adjusting bolt 48. The striking plate is disposed between the portions of lever member 38 at a location sufficiently above handle 10 so as not to interfere with the pivoting action of handle 16. The bolt mount is disposed at a location on web 24 where the adjusting bolt may be adjusted to contact the striker plate limiting the travel of handle 16.

Overcenter linkage 18 is of elongated shape having first and second ends. The first end of the linkage is pivotally attached to lever member 38 at a point 50, and the second end is pivotally attached to pivoting jaw 14 at a point 52. Preferably, the first end of the linkage is disposed within the channel, where it is attached at point 52 by a suitable mounting bolt. The second end of the linkage is disposed between the portions of lever member 38 and is there pivotally secured by another suitable mounting bolt at point 50.

Figure 2:
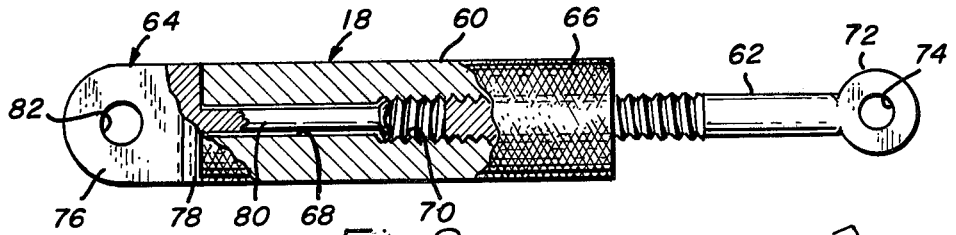
FIG. 2 is a partially broken side elevation further illustrating the overcenter linkage shown in FIG. 1.

The preferred embodiment of overcenter linkage 18 is shown in FIG. 2 to include an adjusting portion 60, an eyebolt 62 and a swivel portion 64. The adjusting portion is of generally cylindrical shape having knurling 66 in its cylindrical surface. A first bore 68 extends axially through the adjusting portion. A second bore 70, larger in diameter than the first bore, extends axially from a first end of the adjusting portion to its center. The second bore is threaded to accommodate the threaded portion of eyebolt 62. The eye 72 of the eyebolt is of such dimension as to fit between the portions of the lever member, and the hole 74 in the eyebolt is of such diameter as to accommodate the mounting bolt. By rotating adjusting portion 60 with respect to eyebolt 62, the eyebolt is threaded into or out of the adjusting portion decreasing or increasing the length of the overcenter linkage.

Swivel portion 64 has a head 76, a flange 78 and a shaft 80. The head has a flattener shape of such thickness as to fit within the channel of the pivoting jaw and contains a hole 82 of such diameter as to accommodate the mounting bolt. The head flares to form the flange which bears against the second end of the adjusting portion. Extending axially from the flange is the shaft which is disposed within the first bore in the adjusting portion. The distal end of the shaft is flared retaining the shaft within the adjusting portion while permitting rotation therebetween.

Figure 3:
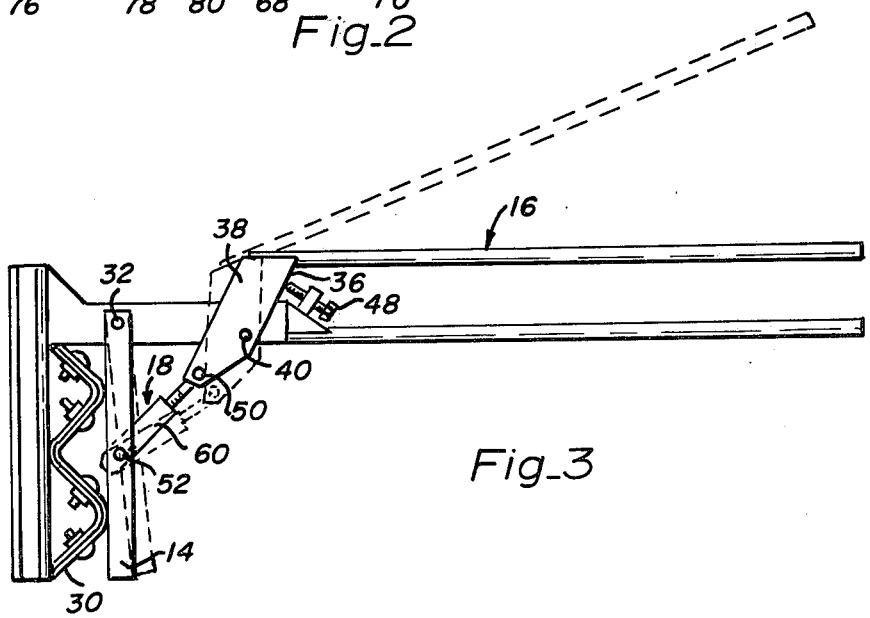
FIG. 3 is a side elevation illustrating the operation of the guard rail assembling clamp shown in FIG. 1.

In FIG. 3, the metal beam guard rail assembling clamp is illustrated in solid lines clamping guard rail sections 30. The clamp is shown in dashed lines as it appears in the open position. As handle 16 is raised to the dashed position, lever member 38 is caused to rotate around point 40 drawing overcenter linkage 18 back. This causes pivoting jaw 14 to rotate about point 32, thus, permitting the insertion or removal of the guard rail sections.

To assemble guard rail sections, two sections are overlapped a sufficient distance and the jaws of the clamp are placed over the sections. Next, handle 16 is rotated from the dashed position to the solid position rotating lever member 38 which causes overcenter linkage 18 to move pivoting jaw 14 to a position against and compressing the guard rail sections. In this position the holes of the guard rail sections will align permitting insertion of the guard rail mounting bolts.

In the closed position points 52, 50 and 40 will form a straight line. In this position force on pivoting jaw 14 will not be translated into rotational force by lever member 38. Thus, continual pressure on handle 16 is not necessary to maintain the clamp in the closed position.

To assist in rapidly finding, without overshooting, the closed position, adjusting bolt 48 is adjusted so as to contact striker plate 44 in the closed position. Should additional force be required to compress the guard rail sections or different thickness guard rail sections be encountered, the length of overcenter linkage 18 may be increased or decreased by rotating the adjusting portion 60.

Although it is contemplated that after having read the preceding disclosure certain alterations and modifications of the present invention will no doubt become apparent to those skilled in the art, it is intended that the following claims be interpreted to cover all such alterations and modifications as fall within the true spirit and scope of the invention.

What is claimed is:

1. A clamp for compressing guard rail sections comprising:

a fixed jaw;

a first handle rigidly attached to said fixed jaw;

a movable jaw pivotally attached to said first handle and facing said fixed jaw, said first and second jaws defining a clamping aperture therebetween;

an elongated lever member pivotally attached at its midpoint to said first handle;

a second handle pivotally attached to one end of said lever member; and an elongated linkage member having one end pivotally attached to a midpoint of said movable jaw, and its other end pivotally attached to the other end of said lever member, the length of said linkage member and the portion of said lever member extending from its pivotal attachment point to its said other end being selected to provide an overcenter locking means to lock said movable jaw in a predetermined closed position relative to said fixed jaw.

2. A clamp for compressing guard rail sections as recited in claim 1 wherein said first and second jaws are substantially parallel when in the closed position and wherein said first handle is disposed substantially perpendicular to said final jaw.

3. A clamp for compressing guard rail sections as recited in claim 1 wherein said movable jaw is attached to said first handle between said fixed jaw and the pivotal attachment point of said lever member.

4. A clamp for compressing guard rail sections as recited in claim 1 wherein said clamping aperture is approximately the thickness of two compressed guard rail sections.

5. A clamp for compressing guard rail sections as recited in claim 1 wherein said linkage member includes;

an adjusting portion having a threaded bore pivotally attached to said movable jaw, and an eyebolt having an eyelet pivotally attached to said lever member and having a threaded region disposed in mating relationship with the threaded bore of said adjusting portion whereby the depth to which said eyebolt is screwed into the threaded bore of said adjusting portion determines the leverage transmitted to said movable jaw.

* * * * *